United States Patent [19]

Wisnieski

[11] 4,191,178

[45] Mar. 4, 1980

[54] MASSAGE DEVICE

[76] Inventor: Michael J. Wisnieski, 2863 Mission Blvd., San Diego, Calif. 92109

[21] Appl. No.: 892,304

[22] Filed: Mar. 31, 1978

[51] Int. Cl.[2] ..... A61H 15/00

[52] U.S. Cl. ..... 128/57; 128/38

[58] Field of Search ..... 128/57, 25 B, 38–40

[56] References Cited

U.S. PATENT DOCUMENTS

| | | | |
|---|---|---|---|
| 1,481,038 | 1/1924 | Stephenson | 128/25 B |
| 2,466,470 | 4/1949 | Norris | 128/57 |
| 3,411,498 | 11/1968 | Reiter | 128/57 |
| 4,109,649 | 8/1978 | Iyomasa | 128/25 B |

*Primary Examiner*—Lawrence W. Trapp

*Attorney, Agent, or Firm*—Frank D. Gilliam

[57] ABSTRACT

A resilient theraputic stimulating massage device with a general spherical shape. The outer surface of the sphere has a plurality of frustro conic protuberances. The protuberances have a corrugated outer side wall surface and a concave suction cup at each end.

4 Claims, 1 Drawing Figure

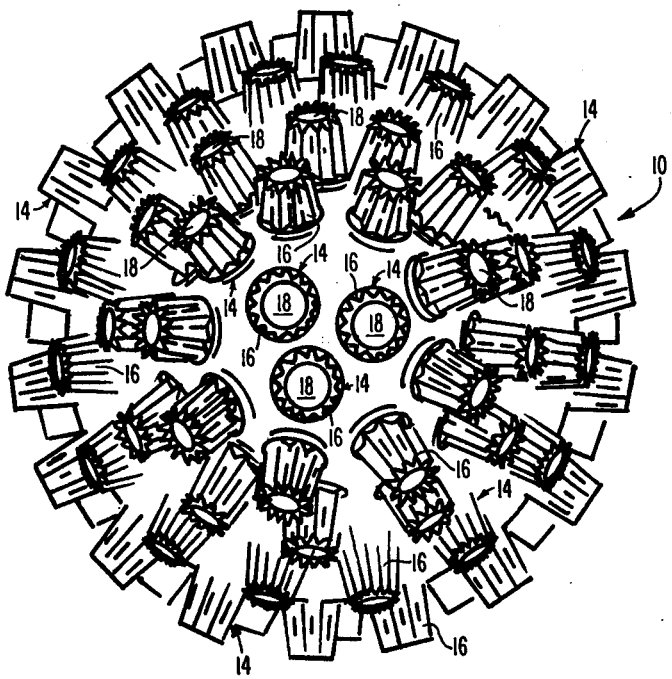
10
14
16
18

MASSAGE DEVICE

BACKGROUND OF THE INVENTION

The invention relates to a theraputic stimulating massage device and more specifically to a device for massaging the feet. Various devices have been utilized to massage the plantar muscles of the feet and most of those devices have found limited success.

The prior art lacks an easily manufactured and inexpensive foot massager having a central resilent sphere which has a plurality of spaced apart corrugated frustro conic protuberances with small suction cups at each end to repeatedly and alternately stretch and compress the skin, muscles and tendons of a foot bottom with sufficient force rapidity over enough closely spaced foot bottom areas to achieve effective convenient and efficient massaging of the foot.

SUMMARY OF THE INVENTION

In view of the deficiencies in the prior art, a primary object of the instant invention is the provision of a portable, easily manufactured and inexpensive foot massager capable of achieving effective, convenient and efficient massaging of a foot.

Another object is to provide a massaging device that can be used on various other portions of the body as a relaxation or stimulation aid.

Another object is to provide a device that provides a large number of uncommon movements to muscle and nerve stimulation.

Still another object of the invention is to provide massage by a multiaction effect including friction, pressure, kneading and stroking of muscle zones.

These and other and further objects and features of the invention will be apparent in the disclosure which includes the above and below specifications, claims, and drawing.

BRIEF DESCRIPTION OF THE DRAWING

The FIGURE depicts the instant invention which includes a ball like center structure with a plurality of frustro-conic protuberances with concave tips.

DETAILED DESCRIPTION OF THE PREFERRED EMBODIMENT

As shown in the figure, the massage device 10 has a spherical core section 12 which could have a circumference sized from 30 to 38 centimeters depending on the general size of the foot to be massaged. A large foot might require a size of 34 to 38 centimeters in circumference while a small foot (such as a child) would require a core circumference of from 30 to 34 centimeters.

Positioned on the outer circumference of the core section 12 and either interical therewith or fixedly secured thereon are a plurality of frusto conic protuberences 14. These protuberances have an outer surface 16 which is corrugated and a concave outer tip portion 18. The protuberances 14 extend outward from the core section 12 from 8 to 16 millimeters and the small foot size would have protuberances from 8 to 12 millimeters in length. The frustro-conic protuberances on the large foot size device have a diameter at the core attached end of from 11 to 17 millimeters and from 9 to 13 millimeters at the outer tip. The frustro-conic protuberances on the small foot size deivce have a diameter of 7 to 11 millimeters at the core attached end and from 6 to 9 millimeters at the outer tip. Typically the suction cup would be the same depth of 1 to 3 millimeters for the above mentioned specific dimensions. It has been found the large foot device in the preferred embodiment will have from 118 to 136 frusto-conic protuberances 14 and the small foot device will have from 100 to 118 frusto-conic protuberances 14. Obviously various other larger and smaller dimensions or numbers of protuberances may be utilized to practice the invention.

The core section 12 and the protuberances 14 are generally constructed of the same or similar material, such as, for example semi-soft synthetic rubber or the like. The device may be molded as a single unit or constructed of a separate core and protuberances. The depth of the corrugations depended on the desired flexibility of the tip end of the protuberances 14.

In use the device is placed, for example, between the foot to be massaged and any hard surface, such as a floor or between both feet and any other part of the body and then rolled. As the ball is rolled back and forth, the many frustro-conic protuberances 14 grasp a small portion of skin and pull that portion to the limit of the suction and/or flexibility of the tip of the protuberance. The rough corrugations aid in the stimulation of the skin during and after the suction of the tip is broken.

While the invention has been described with reference to a specific embodiment the exact nature and scope of the invention is defined in the following claim.

What is claimed is:

1. A massage device comprising:

a central core section;

a plurality of frustro-conic protuberances extending therefrom, said protuberances having an outer corrugated surface and a concave tip.

2. The invention as defined in claim 1, wherein said central core section is substantially spherical.

3. The invention as defined in claim 1, wherein said central core section and protuberances are resilent.

4. The invention as defined in claim 1, wherein said central core has a circumference in the range of from 30 to 38 centimeters, said protuberances have of height in the range of from 8 to 16 millimeters, a base diameter of from 7 to 17 millimaters, a tip diameter from 6 to 13 millimaters and a concave tip of a depth of 1 to 3 millimaters, and the central core has from 100 to 136 protuberances.

* * * * *